US006375186B1

(12) United States Patent
Joo

(10) Patent No.: US 6,375,186 B1
(45) Date of Patent: Apr. 23, 2002

(54) MINI-LOTTERY ABACUS

(75) Inventor: Attila L. Joo, 167 Handel, Candiac QC (CA), J5R 4S2

(73) Assignee: Attila L. Joo, Candiac (CA)

( * ) Notice: Subject to any disclaimer, the term of this patent is extended or adjusted under 35 U.S.C. 154(b) by 0 days.

(21) Appl. No.: 09/589,158

(22) Filed: Jun. 8, 2000

(51) Int. Cl.[7] ..... A63F 3/06

(52) U.S. Cl. ..... 273/114 B; 273/144 R; 273/138.1

(58) Field of Search ..... 273/144 B, 145 C, 273/144 R, 144 A, 145 LA, 138 R, 269, 138.1

(56) References Cited

U.S. PATENT DOCUMENTS 1,560,974 A * 11/1925 Clays
1,602,358 A * 10/1926 Getskay
1,685,183 A * 9/1928 Wilhelm
1,994,977 A * 3/1935 Benson
3,383,792 A * 5/1968 Goldfarb
4,273,335 A 6/1981 Allonsius
4,886,271 A 12/1989 Brown
5,388,723 A 2/1995 Kampmeyer
5,427,374 A 6/1995 Ulloa et al.
5,507,492 A 4/1996 Adell
5,522,591 A 6/1996 Adell
6,012,716 A 1/2000 Adell

* cited by examiner

*Primary Examiner*—William M. Pierce

(57) ABSTRACT

The present invention concerns a device that can be used to easily and randomly draw a plurality of numbers one after the other from a large quantity of differently marked balls contained in a first chamber by a repeated manual activation of a horizontal movable bar that randomly captures one marked ball at a time from a first upper chamber into a cavity in the movable bar and transfers it to an elongated second lower chamber to display the captured and drawn marked balls. The second chamber includes two adjacent elongated channels and a channel selection member that includes a door rotatably mounted onto the device to leave only one of the channels opened and accessible for the captured balls at a time.

9 Claims, 2 Drawing Sheets

MINI-LOTTERY ABACUS

FIELD OF THE INVENTION

The present invention relates to lottery devices, and more particularly to manually operated random selector devices that can draw a marked ball from a pool of such balls.

BACKGROUND OF THE INVENTION

The use of mini-lottery devices to randomly select a few numbers from a pool of such numbers has recently become more important for some members of our societies. For some persons, this has become such an important facet of their lives that it is important for them to, for example, simulate the draw in advance and then make a personal use of the obtained results afterwards. Many different types of mini-lottery devices exist. Some for example pick numbers one after the other while some pick a series of number all at once.

Among the inventions picking numbers one after the other, indicia selector has been disclosed in the prior art in U.S. Pat. No. 4,273,335 issued on Jun. 16, 1981 to G. Allonsius. In this invention, the lower floor of the deposit chamber of the selector is at the same horizontal level than the lower floor of the individual ball receptacle when the device is upright and when the receptacle is lowered at the same level than the deposit chamber, this requires that an inconvenient manual movement be given to the selector to give an angle or a gradient to the lower floor of the individual ball receptacle to ensure that the ball moves in and remains in the deposit chamber of the selector. This is not advantageous since another manual movement must be approximately simultaneously given by means of a downward pressure on the individual ball receptacle.

Furthermore, the system of the trap door to return the balls inside the opaque chamber can bring problems since when the transparent chamber has been emptied, it is highly possible that when the unit is re-turned in its upright position, some balls will inadvertently re-enter the transparent chamber from the opaque chamber before the trap door is closed again, hence possibly necessitating to re-act the emptying maneuver a number of times before it is successfully done.

It should also be mentioned that if the ball receptacle is not spring loaded, the lower section of the ball receptacle could be left as an outer protuberance that could easily be forgotten into such a position, and be broken, irreparably damaging the device, if it would be put away while being in this improper position. Finally, if something goes wrong with the one way trap door system, such as if a blocking occurs, the entire device becomes obsolete when the purpose is to select more than one numbered ball.

To simulate the television draws as visually speaking realistically as possible, which can be of high importance to mini-abacus' users, a device should visually replicate the display of the random selection from the abacuses with an inclined channel where the drawn numbers fall or slide into one after the other to be displayed with grand style. No prior art maximizes the procurement of such a visually speaking realistic re-enactment of the television lottery draws.

OBJECTS OF THE INVENTION

It is therefore a general object of the present invention to provide a manually operated random selector device of the character described which obviates the above noted disadvantages.

Another object of the present invention is to provide a manually operated random selector device that visually replicates a television lottery draw's display of the results.

A further object of the present invention is to provide a manually operated random selector device that randomly selects one after the other a marked ball from a hidden pool of marked balls and displays the resulting series.

Another object of the present invention is to provide a manually operated random selector device that is light, easily operated and carried, and that can be used a plurality number of times.

A further object of the present invention is to provide a manually operated random selector device that requires a minimum number of actions and movements for its use.

A further object of the present invention is to provide a manually operated random selector device that is after use easily and efficiently put back into an operative mode.

Another object of the present invention is to provide a manually operated random selector device that is compact, resistant, ergonomic, and easily manufacturable.

Another object of the present invention is to provide a manually operated random selector device that offers the possibility of changing the quantity of marked balls to simulate different lottery games.

SUMMARY OF THE INVENTION

The present invention consists of a random lottery device comprising a main body including:

- a first chamber freely containing a plurality differently marked balls of similar size and having a lateral opening allowing for only one of said marked balls to pass therethrough at a time;
- a bar axially movable between a first and a second limit positions; and
- a second chamber with transparent walls and opened at one end and adapted to receive a row of a predetermined number of said marked balls, said bar being adjacently located in between both said chambers and including a through hole forming a cavity sized to receive only one of said marked balls and having a first extremity aligned with said lateral opening and a second extremity closed when said bar is in said first position, and having said first extremity closed and said second extremity aligned with said one end of said second chamber when said bar is in said second position; thereby said cavity being capable of capturing one of said marked balls at a time from said first chamber, displacing it and dropping it into said second opening.

Preferably, the random lottery device further comprises a biasing member biasing said bar into said first limit position.

Preferably, the second chamber is sized to receive at least seven of said marked balls side by side.

Preferably, the main body further includes a reservoir chamber adapted to contain a plurality of additional differently marked balls and having a first access door plug member to insert or retrieve said marked and/or additional marked balls therefrom, said first chamber also including a second access door plug member to insert or retrieve said marked and/or additional marked balls therefrom.

Preferably, the transparent walls of said second chamber are slightly convex to act as magnifying glass thereby enhancing visual reading of markings on said marked balls.

Preferably, the bar always remains within a generally rectangular perimeter defined by said main body when at or between said first and second limit positions.

Alternatively, the second chamber includes a plurality of adjacent channels each adapted to receive a row of a predetermined number of said marked balls and a channel selection member, each of said channels being connected at one opened extremity to said one end opening of said second chamber via said channel selection member, the latter leaving access for said marked ball captured into said cavity to enter a selected of said channel at a time while closing the access to the other of said channels.

Preferably, the second chamber includes two of said channels and said channel selection member includes a door rotatably mounted onto said main body in proximity to said one end of said second chamber to close the one opened extremity of either one of the two channels for rotation between two extreme positions corresponding to both closing of a respective channel, and a door knob coaxially secured to said door to enable rotation of the latter.

Preferably, the channel selection member further includes latch members to releasably latch said door in respective said two extreme positions.

Preferably, each of said channels is sized to receive at least ten of said marked balls side by side.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
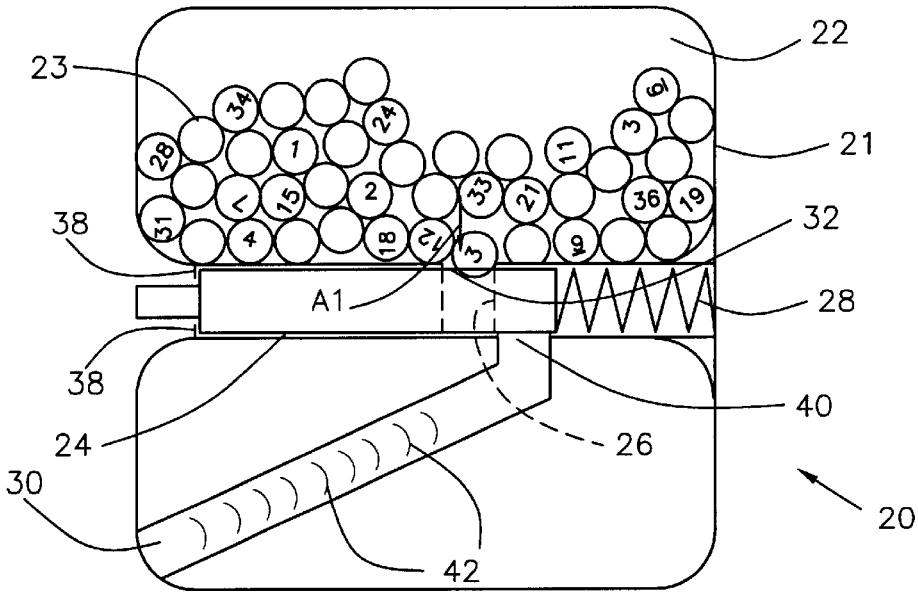
FIG. 1 is an elevation view of an embodiment of a manually operated random selector device according to the present invention with the sliding bar in its biased first limit position.

Referring to FIG. 1, there is shown a first embodiment of a random lottery device 20 according to the present invention comprising a main body 21 having a first chamber 22 filled with a plurality of differently marked balls 23, a horizontally slidable movable bar 24 positioned adjacently to and vertically beneath the chamber 22, a holding cavity 26 included in the movable bar 24, a biasing coil spring 28 secured to the movable bar 24, and a second chamber, preferably a transparent channel 30 preferably positioned with an inclination beneath the movable bar 24.

The first chamber 22, preferably transparent, has a size large enough to ensure that the balls can easily be mixed. When the device 20 is in an upright position, a chamber lateral opening 32 of a diameter of slightly larger than the diameter of that of a ball 23 is located on a lower and substantially central section of the chamber 22, adjacent to the movable bar 24. When the spring 28 is in its first limit position and the device 20 in an upright position, the chamber opening 32 of the chamber 22 and the holding cavity 26 of the movable bar 24 are aligned directly above one-another. When in its first and second limit positions, the movable bar 24, preferably, does not protrude out of and remains within the generally rectangular external perimeter of the body 21 for the device 20 to be easily inserted into a pocket or the like.

Figure 2:
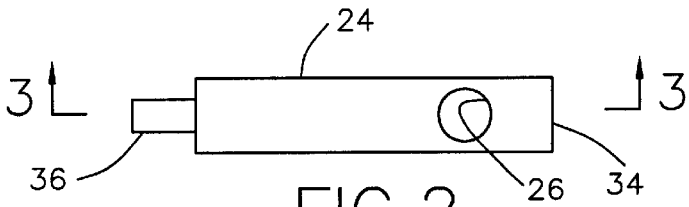
FIG. 2 is a top view of a movable bar of the embodiment of FIG. 1.
Figure 3:
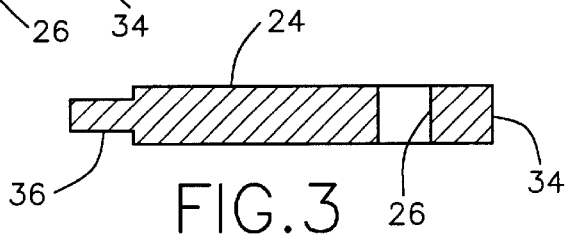
FIG. 3 is a section taken along line 3—3 of FIG. 2.

FIGS. 2 and 3 show a detailed view of the movable bar 24 of generally square cross-section, and in particular the fact that the, holding cavity 26 is, when the device 20 is in an upright position, a generally vertical through hole of a diameter preferably of the same diameter than one of the balls 23, and that the thickness of the movable bar 24 is at least slightly larger than that of the diameter of one of the balls 23. In this biased first limit position with the chamber opening 32 and the holding cavity 26 are vertically aligned, any one of the balls 23 can under gravity fall from the chamber 22 into the holding cavity 26 as indicated by the arrow A1 of FIG. 1.

A first end 34 of the movable bar 24 pushes against to the coil spring 28, itself resting at its other end on a closed side of the body 21 of the device 20. The second end 36 of the movable bar 24 is free to be manually inwardly pushed in order to slide the movable bar 24 in the direction indicated by arrow A2 of FIG. 4 and compress the coil spring 28 (indicated by 28') up to its second limit position. Upon a release of the second end 36 of the movable bar 24, it shall be understood by anyone skilled in the art that the coil biasing spring 28 will expand itself back to its normal position, or up until the movable bar 24 encounters stoppers 38 at its first limit position, and until the chamber opening 32 and the holding cavity 26 are back to being vertically aligned.

Beneath the movable bar 24 is positioned the inclined channel 30 of a diameter of approximately the same diameter than of one of the balls 23. The channel 30 shall also have a length L of approximately the same length as, preferably, seven times the diameter of one of the balls 23 (this length L could be different depending on the required quantity of balls 23 to be drawn for a specific lottery game). A channel opening 40 located at the upper extremity of the channel 30 is located right underneath the holding cavity 26 of the movable bar 24 when the latter has been inwardly pushed in its second limit position. This enables a ball 23 held inside the holding cavity 26 of the movable bar 24 to follow a direction indicated by an arrow A3 on FIG. 4 when the channel opening 40 of the channel 30 and the holding cavity 26 are vertically aligned, and fall under gravity from the holding cavity 26 into the channel 30.

Figure 4:
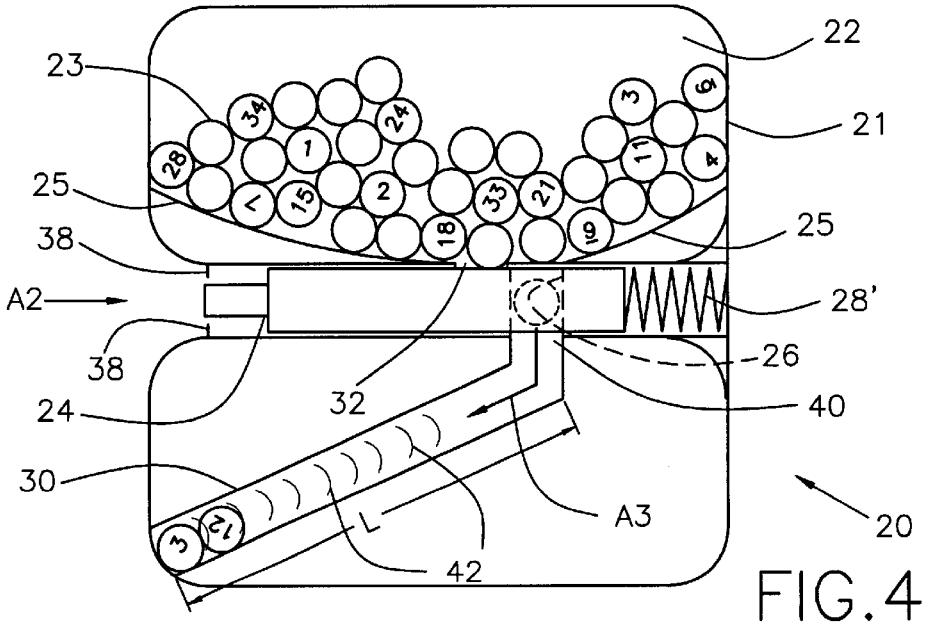
FIG. 4 is an elevation view similar to FIG. 1 showing the sliding bar in its second limit position.
Figure 5:
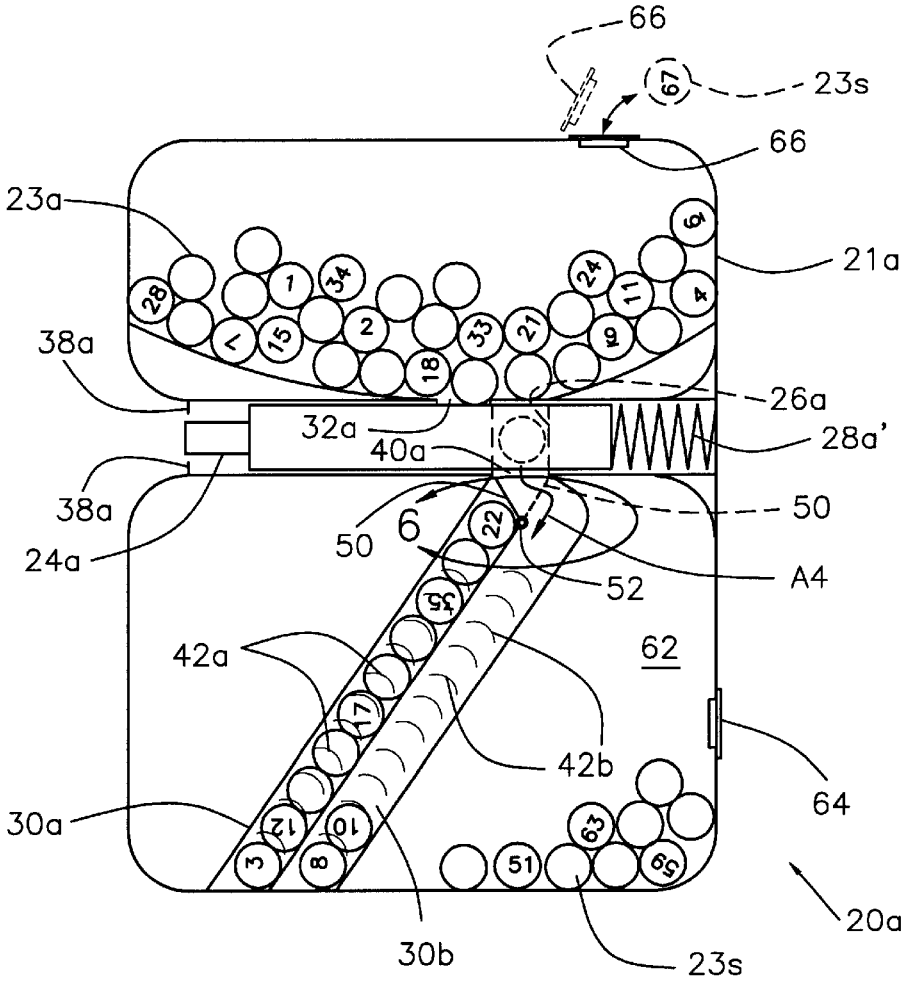
FIG. 5 is an elevation view similar to FIG. 4 showing a second embodiment having a second chamber with two adjacent channels.

Preferably, the transparent side walls of the channel 30 are slightly convex 42, 42*a*, 42*b* to act as magnifying glass to improve the visual reading of the marking on each picked ball 23 that may be small for certain persons, as shown in FIGS. 4 and 5.

The preferred way to play with the device 20 is for a user to hold the latter in his hand and turn the device 20 upside down to ensure there is no ball 23 in the cavity 26. Then push and hold the bar 24 while constantly shaking the device 20 and turning it back in an upright position. While keeping shaking the device 20, the user releases the bar 24 in its first limit position to have a ball 23 entering the cavity 26, then presses the bar 24 again to push the ball 23 above the channel opening 40 to enter the channel 30. Still while shaking the device 20, repeats the releasing and pushing of the bar 24 until a sufficient number of balls 23 are randomly picked and located into the channel 30, depending on the lotto game being played. To empty the channel 30 and re-use the device 20, the latter is turned upside down and held in that position while the user keeps on successively pushing and releasing the bar 24 until all picked balls are returned back into the chamber 22.

Alternatively, the bottom floor 25 of the chamber 22 may be slightly downwardly inclined from the side edges to the opening 32 in order to facilitate the capturing of the marked balls 23 into the cavity 26 of the bar 24, as shown in FIG. 4.

Figure 6:
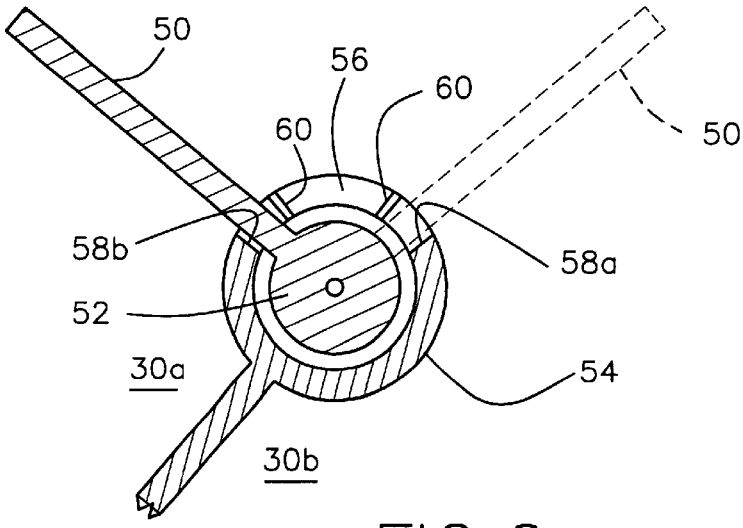
FIG. 6 is a sectional view taken along line 6 of FIG. 5.

As shown in FIGS. 5 and 6, a second embodiment 20*a* (it is to be noted that all similar reference numerals pertaining to the second embodiment 20*a* are followed by an "a" for clarity) includes a plurality of channels 30*a*, 30*b*, preferably two, adjacent to each other and adapted to receive picked balls 23*a* in order to allow playing some lottery games requiring large number of balls per draw. Both channels 30*a*, 30*b* are connected to a common channel opening 40*a*. When a ball 23*a* is released from cavity 26, it is automatically routed, under gravity, to one of the channels 30*a*, 30*b* according to the position of a channel selection member, preferably a channel door 50 manually activated by a door knob 52. As depicted in FIGS. 5 and 6, the door 50 is positioned in a first extreme position to close the entrance of channel 30*a* and force the ball 23*a* coming from the cavity 26 to fall into the second channel 30*b* according to arrow A4. The door 50 is shown in dashed lines in the second extreme position for closing the entrance of channel 30*b*. As better shown in FIG. 6, the door knob 52 freely rotates within a retaining hollowed cylinder member 54 provided with an elongated slot opening 56 along which the door 50 is allowed to move; the door 50 abuts a first extremity 58*a* of the slot opening 56 to force the balls 23*a* to enter channel 30*a* or a second extremity 58*b* to oppositely force the balls 23*a* to enter channel 30*b* when the first one is completely filled with balls 23*a*. Preferably, the slot opening 56 includes slightly inwardly protruding convex latching member 60 to releasably retain the door 50 into its selected extreme position. Only a small torque applied to the knob 52 is sufficient to release the door 50 from the latching member 60. Also, to allow a user to play different lottery games with a same device 20*a*, the latter can be provided with a reservoir chamber 62 accessible via a reservoir door plug 64 and adapted to receive additional add/or spare balls 23*s* having different markings than the one filling the chamber 22*a*. Obviously, the latter also requires an accessible door plug 66 to allow for insertion of new balls 23*s* or retrieval of balls 23*a*, if less balls 23*a* are required for the new game to be played. The accessible door plug 66 is shown in its open position in dashed lines with an additional ball 23*s* being inserted into the chamber 22*a*. As it shall be readily understood by anyone skilled in the art, any other type of door plugs could be used such as sliding doors.

Although embodiments have been described herein with some particularity and details, many modifications and variations of the preferred embodiments are possible without deviating from the scope of the present invention.

I claim:

1. A random lottery device comprising a main body including:

a first chamber freely containing a plurality differently marked balls of similar size and having a lateral opening allowing for only one of said marked balls to pass therethrough at a time;

a bar axially movable between a first and a second limit positions;

a biasing member biasing said bar into said first limit position;

a second chamber with transparent walls and opened at one end and including two adjacent channels each adapted to receive a row of a predetermined number of said marked balls, said bar being adjacently located in between both said chambers and including a through hole forming a cavity sized to receive only one of said marked balls and having a first extremity aligned with said lateral opening and a second extremity closed when said bar is in said first position, and having said first extremity closed and said second extremity aligned with said one end of said second chamber when said bar is in said second position; thereby said cavity being capable of capturing one of said marked balls at a time from said first chamber, displacing it and dropping it into said second opening; said second chamber includes a channel selection member, each of said channels being connected at one opened extremity to said one end opening of said second chamber via said channel selection member, the latter leaving access for said marked ball captured into said cavity to enter a selected of said channel at a time while closing the access to the other of said channels;

said channel selection member includes a door rotatably mounted onto said main body in proximity to said one end of said second chamber to close the one opened extremity of either one of the two channels for rotation between two extreme positions corresponding to both closing of a respective channel, and a door knob coaxially secured to said door to enable rotation of the latter.

2. A random lottery device as defined in claim 1, wherein said channel selection member further includes latch members to releasably latch said door in respective said two extreme positions.

3. A random lottery device as defined in claim 2, wherein said main body further includes a reservoir chamber adapted to contain a plurality of additional differently marked balls and having a first access door plug member to insert or retrieve said marked and/or additional marked balls therefrom, said first chamber also including a second access door plug member to insert or retrieve said marked and/or additional marked balls therefrom.

4. A random lottery device as defined in claim 2, wherein said transparent walls of said second chamber are slightly convex to act as magnifying glass thereby enhancing visual reading of markings on said marked balls.

5. A random lottery device as defined in claim 2, wherein each of said channels is sized to receive at least seven of said marked balls side by side.

6. A random lottery device as defined in claim 2, wherein each of said channels is sized to receive at least ten of said marked balls side by side.

7. A random lottery device as defined in claim 1, wherein said main body further includes a reservoir chamber adapted to contain a plurality of additional differently marked balls and having a first access door plug member to insert or retrieve said marked and/or additional marked balls therefrom, said first chamber also including a second access door plug member to insert or retrieve said marked and/or additional marked balls therefrom, said second chamber is sized to receive at least seven of said marked balls side by side.

8. A random lottery device as defined in claim 1, wherein said transparent walls of said second chamber are slightly convex to act as magnifying glass thereby enhancing visual reading of markings on said marked balls.

9. A random lottery device as defined in claim 1, wherein each of said channels is sized to receive at least seven of said marked balls side by side.

* * * * *